US006692291B2

(12) United States Patent
Chen

(10) Patent No.: US 6,692,291 B2
(45) Date of Patent: Feb. 17, 2004

(54) CABLE PIERCING DEVICE FOR USE WITH A PLUG

(76) Inventor: Ching-Hsiung Chen, No. 77, Chuan-Fu-Rd., Cheng-Kung Village, Jen-Te Hsiang, Tainen Hsien (TW)

( * ) Notice: Subject to any disclaimer, the term of this patent is extended or adjusted under 35 U.S.C. 154(b) by 0 days.

(21) Appl. No.: 10/138,007

(22) Filed: May 2, 2002

(65) Prior Publication Data

US 2003/0207618 A1 Nov. 6, 2003

(51) Int. Cl.[7] ..... H01R 4/24
(52) U.S. Cl. ..... 439/417
(58) Field of Search ..... 439/395, 417, 439/651, 652, 622

(56) References Cited

U.S. PATENT DOCUMENTS 5,482,478 A * 1/1996 Liao ..... 439/622
6,120,315 A * 9/2000 Gaertner et al. ..... 439/395

FOREIGN PATENT DOCUMENTS

FR 2562337 * 10/1985

* cited by examiner

*Primary Examiner*—Khiem Nguyen
(74) *Attorney, Agent, or Firm*—Thorp Reed & Armstrong LLP

(57) ABSTRACT

A plug has at least one passage that is defined in a bottom of the body to communicate an interior of the body to allow at least one cable to extend into the body. At least one prong is securely mounted on a seat formed on the body and has a first extension, a second extension and a contacting plate. The first and second extensions extend in a direction opposite to a direction of the contacting plate. A pusher extends into the body for pushing the at least one cable toward the at least one prong. The at least one cable is bent due to the pusher extending into the body and thus the at least one prong is able to pierce through an outer covering of the at least one cable that is inserted into the body from the at least one passage.

1 Claim, 5 Drawing Sheets

CABLE PIERCING DEVICE FOR USE WITH A PLUG

BACKGROUND OF THE INVENTION

1. Field of the Invention

The present invention relates to a cable piercing device, and more particularly to a cable piercing device for use with an electric plug. The cable piercing device has a metal prong adapted to be received in the plug and a pusher receivable in the plug to push a cable inserted into the plug toward the prong so that the prong is able to pierce through the covering of the cable so contact to the core of the cable.

2. Description of Related Art

When a conventional plug is fitted to an electrical cable, the cores comprising copper strands inside the cable must first be exposed by stripping away the plastic sheathing. However, cutting the sheathing but not the core strands is quite difficult for the lay person. After the exposure of the core, the user may wind the core around a contacting plate so that when the contacting plate is inserted into an outlet, the power is able to be transmitted by the cable. Again, it is quite troublesome to wind the core around the appropriate plate and ensure that strands from two cores do not contact each other. It is noted from the foregoing description that the fitting of the plug to an electrical cable is very time consuming and labor intensive.

To overcome the shortcomings, the present invention tends to provide an improved cable piercing device to mitigate and obviate the aforementioned problems.

SUMMARY OF THE INVENTION

The primary objective of the present invention is to provide an improved cable piercing device for use with a plug. The cable piercing device has a prong adapted to be received in the plug to be used to pierce through the covering of the cable so that the prong is able to engage with the core of the cable.

Another objective of the present invention is to provide a door adapted to be slidable relative to the plug so that the user is able to readily replace a malfunctioned fuse inside the plug.

Other objects, advantages and novel features of the invention will become more apparent from the following detailed description when taken in conjunction with the accompanying drawings.

DETAILED DESCRIPTION OF THE PREFERRED EMBODIMENT

Figure 1:
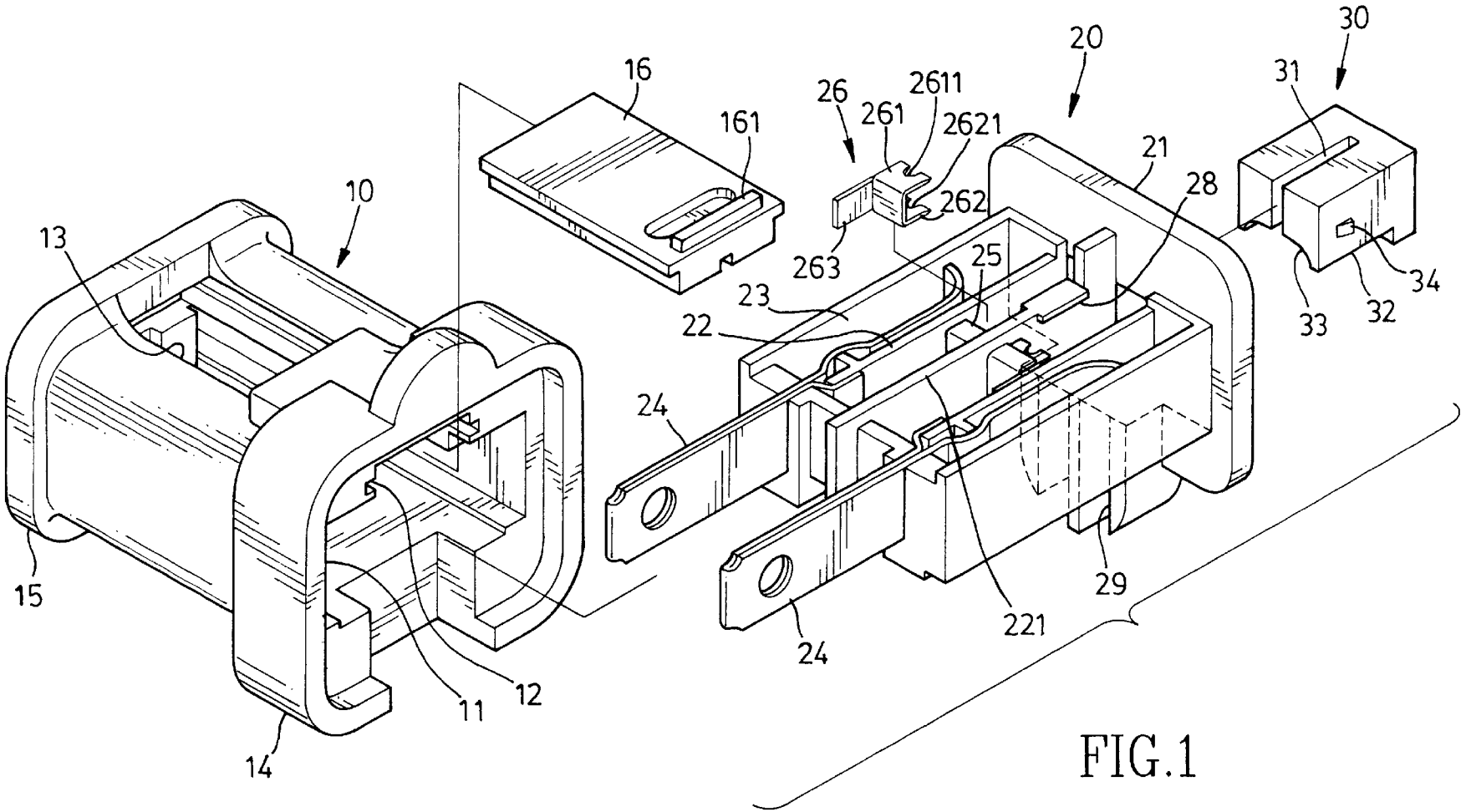
FIG. 1 is an exploded perspective view of a plug in combination with the prong and the pusher of the present invention.

With reference to FIG. 1, a plug generally has a hollow casing (10) and a body (20) inserted into the casing (10). The casing (10) has an opening (11) defined in a side face thereof, a track (12) defined in the side face to communicate the opening (11) and a hole (13) defined in a top face to communicate the track (12) and an interior of the hollow casing (10). The casing (10) further has a first flange (14) and a second flange (15) respectively formed on opposite side faces thereof, and a door (16) so configured that the door is able to be securely and slidably received in the track (12) of the casing (10) so as to selectively close the hole (13). The door (16) has a stop (161) formed on a top face thereof to correspond to the second flange (15) of the casing (10) so that when the door (16) is sliding in the track (12) toward the second flange (15), the engagement between the stop (161) and the second flange (15) prevents the door (16) from excess movement to fall out of the casing (10) and therefore retains the door (16) in the track (12).

The body (20) has a flange (21) formed on one side thereof and baffles (22) formed inside the body (20) to define inside the body (20) partitions (23) to receive therein blades (24). Two seats (25) are formed on two adjacent partitions (23) so that two prongs (26) are able to rest on the two seats (25) respectively. Each prong (26) has a pair of extensions (261,262) extending in the same direction and a contacting plate (263) extending in a direction opposite to the extending direction of the extensions (261,262). Each extension (261, 262) has a central cutout (2611,2621) and a free end thereof is sharp. The body (20) further has a pusher (30) receivable in the body (20). The pusher (30) has a centrally defined slit (31) defined to correspond to a central baffle (221) dividing the two seats (25), a cutout (32) defined in a bottom face thereof, an arcuate top face (33) defining the cutout (32) and two bosses (34) formed on opposite side faces of the pusher (30). Two passages (29) are respectively defined in a bottom of the body (20) to communicate the interior of the body (20).

Figure 2:
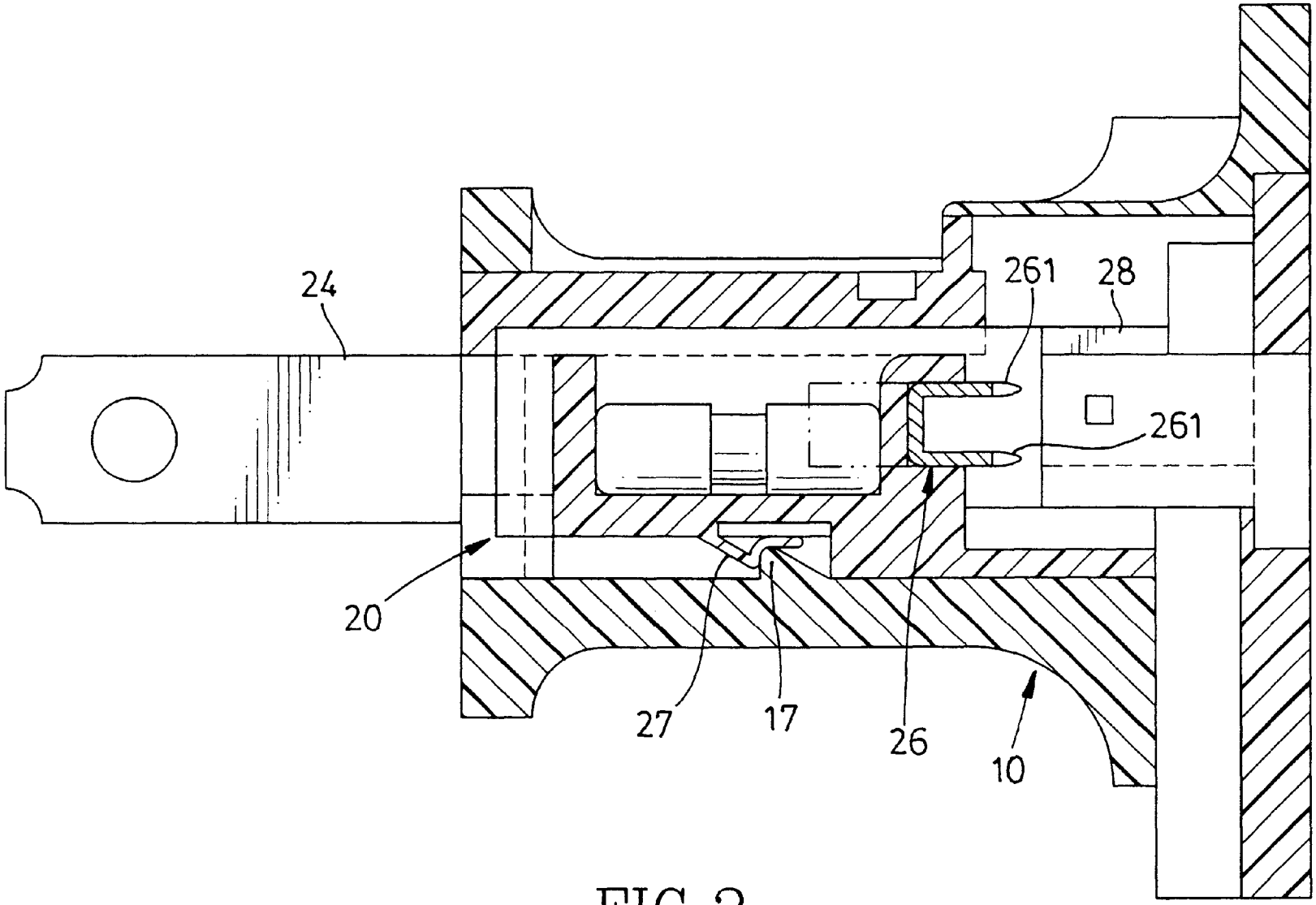
FIG. 2 is a side cross sectional view showing that the prong and the pusher are received in the plug.

With reference to FIG. 2, when the plug is assembled, it is to be noted that the body (20) is inserted into the hollow casing (10) after the door (16) is inserted into the corresponding track (12) so that the door (16) is stopped by the flange (21) of the body (20) from moving out of the plug. After the body (20) is inserted into the casing (10), a first barb (17) formed on an inner face of a bottom of the casing (10) engages a second barb (27) formed on an outer face of a bottom of the body (20) so that the engagement between the casing (10) and the body (20) is secured. When the engagement of the body (20) to the casing (10) is secured, it is noted that the blades (24) extend out from a side face of the second flange (15) so as to be able to connect to an outlet (not shown). The pusher is pushed by a user's finger into the body (20) from the flange (21) with the central baffle (22) received in the corresponding slit (31). After the pusher (30) is received in the body (20), a guiding plate (28) is on top of the pusher (30) so that the movement of the pusher (30) in the body (20) is restricted.

Figure 3:
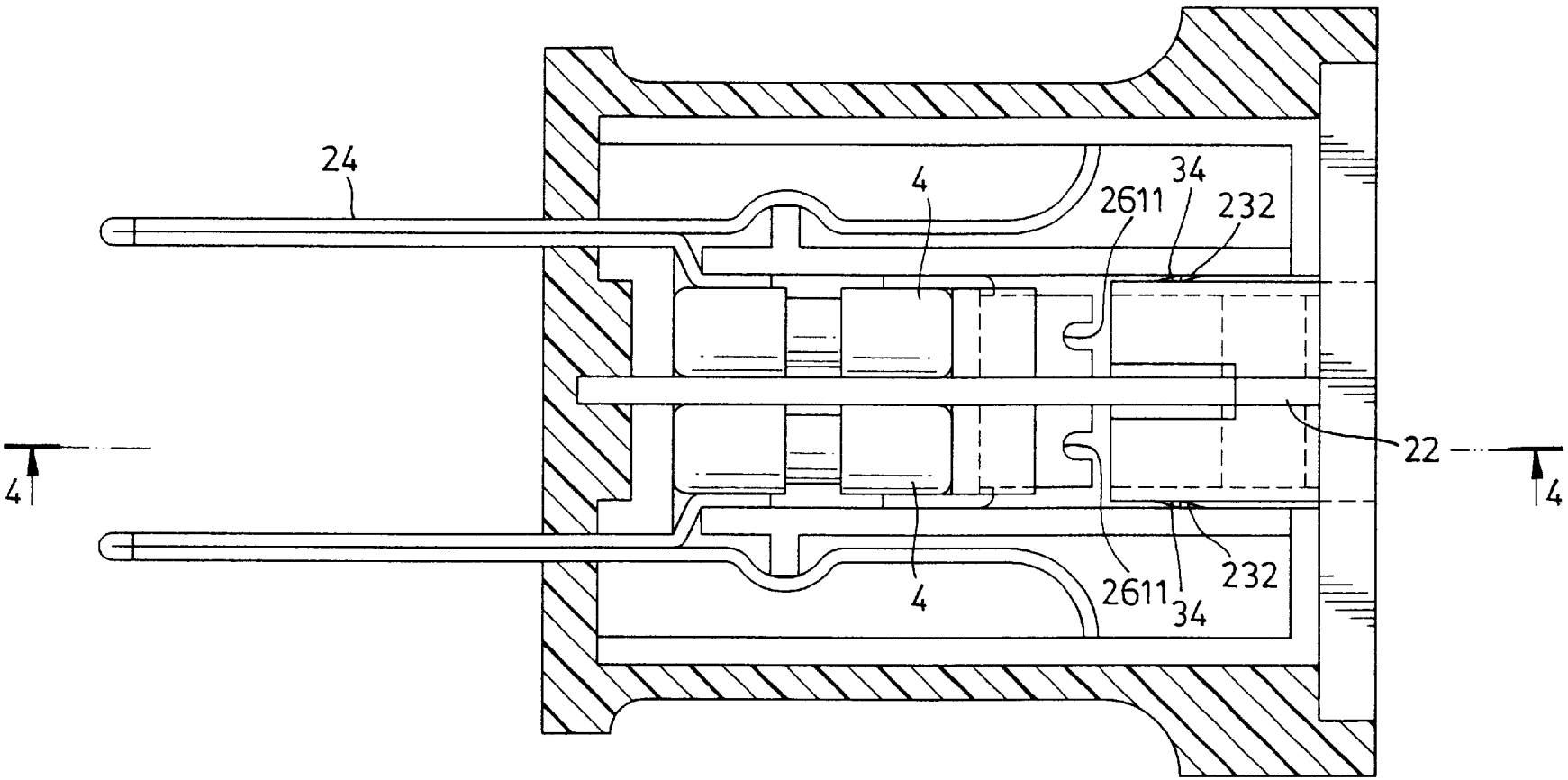
FIG. 3 is a top cross sectional view of the plug showing the position of the two prongs.

With reference to FIG. 3, after the two prongs (26) are respectively mounted on the seats (25), the two contacting plates (263) engage with two fuses (4) respectively received in the partitions (23) divided by the central baffle (22) such that the two prongs (26) are electrically connected to the two blades (24). Furthermore, a first boss (231) and a second boss (232) are respectively formed on an inner side face of the two partitions (23) to correspond to the boss (34) of the pusher (30) so that after the pusher (30) is received in the body (20), the engagement of the two bosses (34) to the first and second bosses (231,232) of the body (20) secure the position of the pusher (30) inside the body (20).

Figure 4:
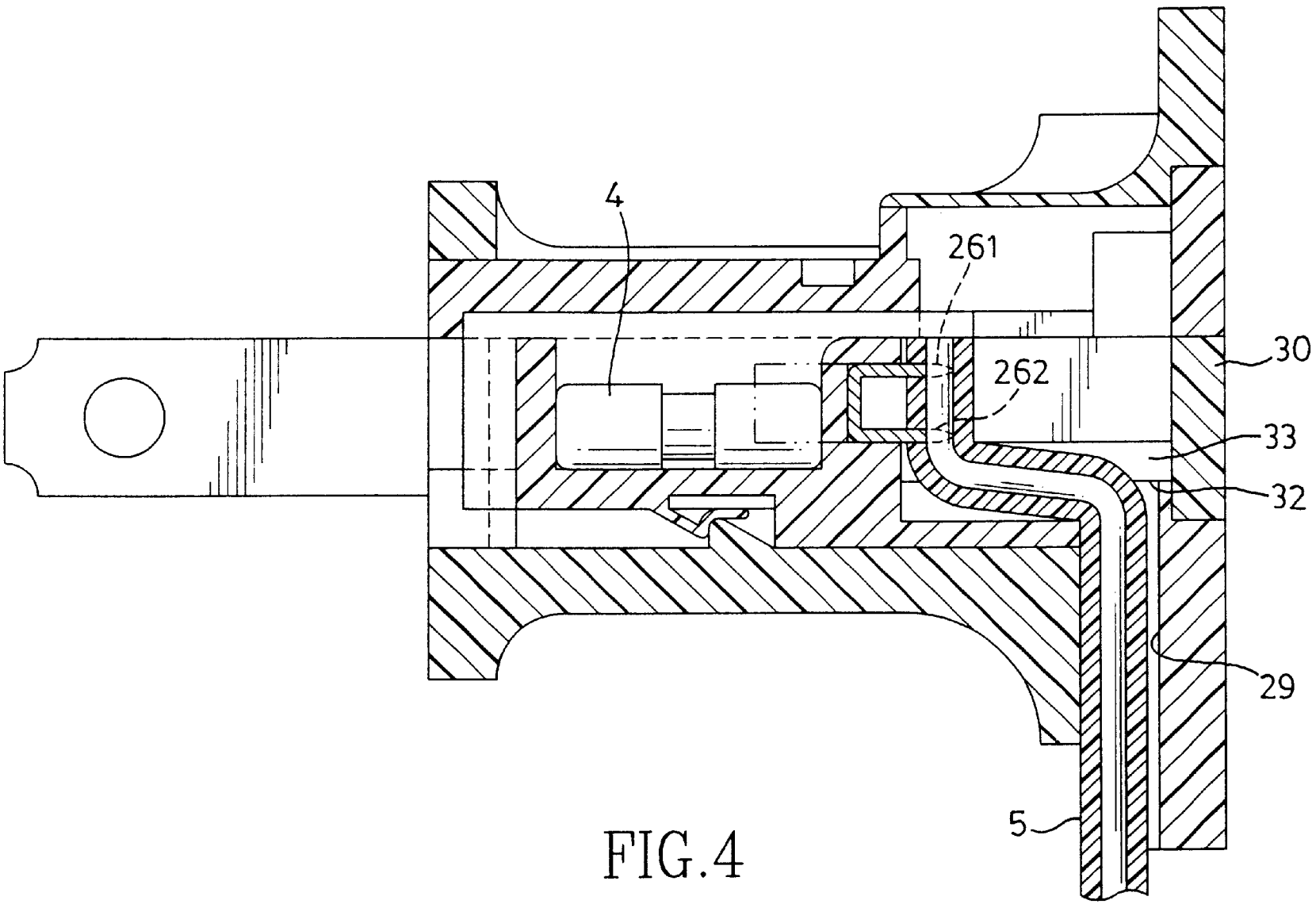
FIG. 4 is a side cross sectional view showing that two cables are inserted into the plug to be pierced by the prongs.

With reference to FIG. 4, before the pusher (30) is pushed to be received in the body (20), two cables (5) are inserted into the two passages (29). After a predetermined length of each cable (5) is inserted into the respective passage (29), the pusher (30) is inserted into the body (20) so as to bend the cables (5) and push the cables (5) toward the two prongs (26). After the cables (5) are bent, the two cables (5) are received in the cutout (32) of the pusher (30) and the arcuate top face of the pusher (30) mate the contours of the two cables (5) so that the two cables (5) are secured relative to the pusher (30).

Figure 5:
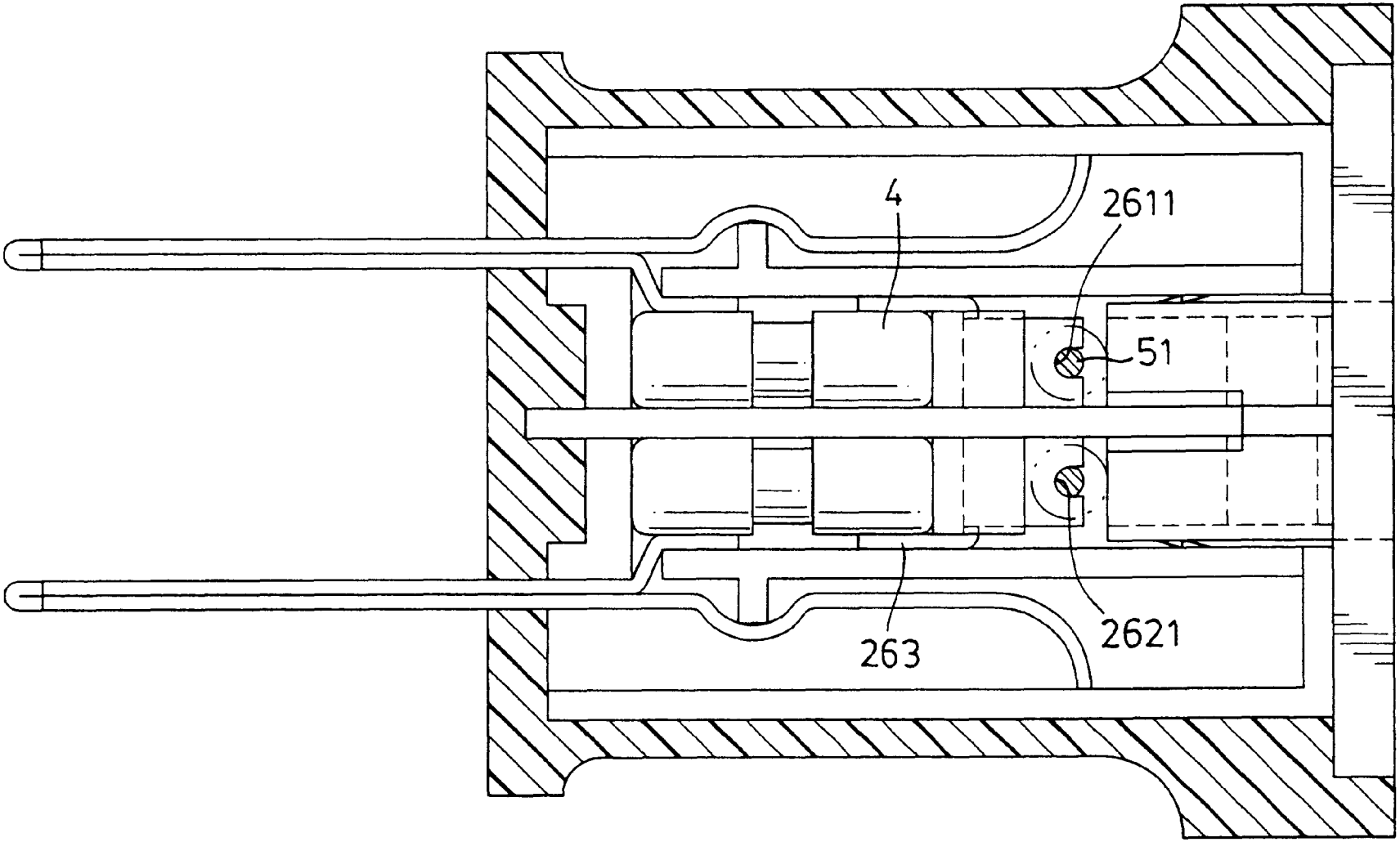
FIG. 5 is a top cross sectional view showing the prongs relative to the position of the cables.

When the pusher (30) pushes the two cables (5) toward the two prongs (26), the two extensions (261,262) pierce through the outer covering of the two cables (5) and engage with the cores (51). After piercing through the outer covering of the cables (5), the cores (51) are received in the central cutouts (2611,2621) respectively, as shown in FIG. 5.

With such an arrangement, the cables are not required to be processed before engaging with the blades (24). The user is able to use the cables (5) directly so as to achieve the purpose of electrical engagement between the blades (24) and the cable cores (51).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. In a plug having a hollow casing, a body securely inserted in the casing and provided with two blades extending out of the casing for engaging with a power outlet, wherein the improvements comprise:

at least one passage adapted to be defined in a bottom of the body for communication with an interior of the body to allow at least one cable to extend into the body, at least one prong adapted to be securely mounted on a seat adapted to be formed on the body and having a first extension, a second extension and a contacting plate, wherein the first and second extensions extend in a direction opposite to a direction of the contacting plate, and a pusher adapted to extend into the body for pushing the at least one cable toward the at least one prong, wherein two passages are adapted to be defined in a bottom of the body, and two prongs are adapted to be mounted on two seats in the body, wherein each of the first and second extensions has a central cutout defined to align with each other, the central cutouts of the first and second extensions are so defined that after the outer coverings of the two cables are pierced through by the first and second extensions, the central cutouts of each of the first and second extensions are adapted to receive therein cores of the two cables, whereby the at least one cable is bent due to the pusher extending into the body and thus the at least one prong is able to pierce through an outer covering of the at least one cable that is inserted into the body from the at least one passage.

* * * * *